US007973617B2

(12) United States Patent
Yurugi et al.

(10) Patent No.: US 7,973,617 B2
(45) Date of Patent: Jul. 5, 2011

(54) UNEQUAL THREE-WAY DIVIDER FOR IN-PHASE SIGNAL DIVISION

(75) Inventors: Hiroyuki Yurugi, Osaka (JP); Wataru Noguchi, Osaka (JP)

(73) Assignee: Panasonic Corporation, Osaka (JP)

( * ) Notice: Subject to any disclaimer, the term of this patent is extended or adjusted under 35 U.S.C. 154(b) by 176 days.

(21) Appl. No.: 12/442,477

(22) PCT Filed: Sep. 20, 2007

(86) PCT No.: PCT/JP2007/068303

§ 371 (c)(1),
(2), (4) Date: Mar. 23, 2009

(87) PCT Pub. No.: WO2008/038576

PCT Pub. Date: Apr. 3, 2008

(65) Prior Publication Data

US 2010/0039187 A1 Feb. 18, 2010

(30) Foreign Application Priority Data

Sep. 25, 2006 (JP) ..... 2006-259285

(51) Int. Cl.
*H01P 3/08* (2006.01)
*H01P 5/12* (2006.01)

(52) U.S. Cl. ..... 333/128; 333/134; 333/136

(58) Field of Classification Search ..... 333/125, 333/127, 128, 134, 136, 238, 124, 126, 129
See application file for complete search history.

(56) References Cited

U.S. PATENT DOCUMENTS 3,953,702 A * 4/1976 Bickel ..... 219/761
4,129,839 A * 12/1978 Galani et al. ..... 333/128
4,386,324 A * 5/1983 Schellenberg ..... 330/277
(Continued)

FOREIGN PATENT DOCUMENTS

JP 57-091004 A 6/1982
(Continued)

OTHER PUBLICATIONS

Parad et al; "Split-Tee Power Divider", IEEE Transactions on Microwave Theory and Techniques, Jan. 1965.

(Continued)

*Primary Examiner* — Robert Pascal
*Assistant Examiner* — Kimberly E Glenn
(74) *Attorney, Agent, or Firm* — Pearne & Gordon LLP

(57) ABSTRACT

An unequal three-way divider divides an input signal into three in-phase signals whose power ratio is different between a center and both ends. The unequal three-way divider includes an input terminal, and three output terminals for outputting a three-divided signal respectively, and three transmission lines branched from the input terminal are provided between the input terminal and the three output terminals. The transmission line connected to the center output terminal has a first transmission line which is connected in series and a second transmission line whose electrical length is ¼ wave length. Two transmission lines connected to the output terminals at both ends have a third transmission line which is connected in series and a fourth transmission line whose electrical length is ¼ wave length respectively. An absorption resistor is provided between a connection point between the first transmission line and the second transmission line and connection points between the third transmission lines and the fourth transmission lines respectively. An electrical length of the first transmission line or the third transmission line is ¼ wave length.

4 Claims, 19 Drawing Sheets

U.S. PATENT DOCUMENTS

| | | | | | |
|---|---|---|---|---|---|
| 4,547,745 | A | * | 10/1985 | Freitag et al. | 330/286 |
| 4,639,694 | A | * | 1/1987 | Seino et al. | 333/128 |
| 5,021,755 | A | * | 6/1991 | Gustafson | 333/128 |
| 5,079,527 | A | * | 1/1992 | Goldfarb | 333/127 |
| 6,005,442 | A | | 12/1999 | Maeda et al. | |
| 6,310,788 | B1 | * | 10/2001 | Myer | 363/39 |
| 7,164,903 | B1 | * | 1/2007 | Cliff et al. | 333/81 R |
| 7,541,892 | B2 | * | 6/2009 | Gorostegui | 455/327 |

FOREIGN PATENT DOCUMENTS

| | | | |
|---|---|---|---|
| JP | S58-37220 | U | 3/1983 |
| JP | 02-029004 | A | 1/1990 |
| JP | 05-037212 | A | 2/1993 |
| JP | 05-251910 | A | 9/1993 |
| JP | 9-321509 | A | 12/1997 |
| JP | 2000-307313 | A | 11/2000 |
| JP | 2001-028507 | A | 1/2001 |

OTHER PUBLICATIONS

Wilkinson; "An N-Way Hybrid Power Divider", IRE Transactions on Microwave Theory and Techniques, Jan. 1960.

Tahara et al; "A Broadband Traveling-Wave Power Divider/Combiner Using Asymmetric Tapered-Line Power Dividers", IEICE Technical Report, Jul. 14, 2004, vol. 104, No. 207, pp. 103-106, MW2004-58.

International Search Report for PCT/JP2007/068303.

* cited by examiner

PRIOR ART

PRIOR ART

PRIOR ART

PRIOR ART

UNEQUAL THREE-WAY DIVIDER FOR IN-PHASE SIGNAL DIVISION

TECHNICAL FIELD

The present invention relates to an unequal three-way divider for dividing an input signal into three signals and outputting the divided signals.

BACKGROUND ART

At a preceding stage of the array antenna provided with a plurality of radiation elements, a divider for dividing a high-frequency signal into plural signals and feeding the divided signals to the radiation elements respectively is provided. FIG. 16 shows an array antenna with four radiation elements and a four-way divider. The four-way divider shown in FIG. 16 has one input terminal 1, four output terminals 2 to 5, three Wilkinson-type two-way dividers (see Non-Patent Literature 1) 111, 112, 113, and transmission lines 115 to 120. One radiation element 110 is connected to the output terminals respectively. Respective paths from the input terminal 1 to four output terminals 2 to 5 constitute a tree structure that is formed by the Wilkinson-type two-way dividers 111, 112, 113 and the transmission lines 115 to 120.

FIG. 17 shows a configuration of the Wilkinson-type two-way divider provided to the four-way divider shown in FIG. 16. As shown in FIG. 17, the Wilkinson-type two-way divider is equipped with one input terminal 6, two output terminals 7, 8, transmission lines M101 to M105, and an absorption resistor R100. As shown in FIG. 17, respective paths from the input terminal 6 to two output terminals 7, 8 has a structure that is branched to two paths at the succeeding stage of the transmission line M101.

One branched line of the two paths consists of the transmission lines M102, M104, and the other branched line consists of the transmission lines M103, M105. Electrical lengths of the transmission lines M102, M103 are set to ¼ wave length respectively. Since respective electrical lengths of the transmission lines M102, M103 are set to ¼ wave length, a reflected wave from the output terminals 7, 8 to the input terminal 6 can be reduced and also isolation between the output terminals can be enhanced. The absorption resistor R100 is connected in a position, which is away by ¼ wave length from a branch point toward the output terminal side, to connect two paths. Since the absorption resistor R100 is provided, isolation between the output terminals can be enhanced and also output impedances can be matched.

Assume that a characteristic impedance of the transmission line M101 is $Z_1$, a characteristic impedance of the transmission line M102 is $Z_2$, a characteristic impedance of the transmission line M103 is $Z_3$, a characteristic impedance of the transmission line M104 is $Z_4$, a characteristic impedance of the transmission line M104 is $Z_5$, a resistance value of the absorption resistor R100 is R100, the divided number is N (=2), and a characteristic impedance $Z_0$ of the infinite length line is 50Ω, relational expressions are given as follows:

$$Z_1=Z_4=Z_5=Z_0=50\Omega$$

$$Z_2=Z_3=Z_0\sqrt{N}=70.7\Omega$$

$$R100=Z_0\cdot N=100\Omega$$

In the array antenna and the four-way divider explained as above, power levels of respective signals supplied to four radiation elements in phase with each other have an influence upon the radiation characteristic of the array antenna. FIG. 18 shows the radiation characteristic of the array antenna when a power on an equal level is supplied to four radiation elements shown in FIG. 16 respectively. In contrast, FIG. 19 shows the radiation characteristic of the array antenna when a ratio of a level of the power supplied to the radiation elements at both ends out of four radiation elements with respect to a level of the power supplied to two radiation elements in the center is set to 1:4. When a comparison of the level of side lobes and the level of a main lobe is made between FIG. 18 and FIG. 19, the level of side lobes of the radiation characteristic shown in FIG. 19 is lower than that in FIG. 18. In this manner, in order to accomplish the array antenna with the radiation characteristic whose side lobe level is low, the divider that is capable of feeding a power to respective radiation elements at an in-phase and unbalanced power ratio is needed.

Non-Patent Literature 2 discloses a two-way divider that divides an input signal into two signals at an in-phase and any power ratio. Also, Patent Literature 1 discloses a divider in which the two-way dividers for dividing an input signal into two signals at an any power ratio are combined in a multi-stage fashion. In the divider disclosed in Patent Literature 1, the power ratio at the output terminals is set to a desired value in terms of a ratio of the characteristic impedances of the matching lines constituting the two-way divider circuit. Also, since an electrical length difference Δφ of the output terminal of the two-way divider in the n-th stage is adjusted in response to a reflection phase at the branch point in the (n−1)-th stage, a phase error at a center frequency between the output terminals can be reduced and thus the side lobe level of the array antenna can be reduced.

Patent Literature 1: JP-A-5-251910

Non-Patent Literature 1: ERNEST J. WILKINSON, "An N-Way Hybrid Divider", Vol. MTT-8, IRE TRANSACTIONS ON MICROWAVE THEORY AND TECHNIQUES, 1960 January, pp. 116-118

Non-Patent Literature 2: L. I. PARAD, AND R. L. MOYNIHAN, "Split-Tee Divider", Vol. MTT-13, IEEE TRANSACTIONS ON MICROWAVE THEORY AND TECHNIQUES, 1965 January, pp. 91-95

DISCLOSURE OF THE INVENTION

Problems that the Invention is to Solve

However, the divider set forth in Non-Patent Literature 2 can divide an input signal into two signals, but the divider cannot divide the input signal into three signals. Similarly, the divider circuit set forth in Patent Literature 1 can divide an input signal into two or four signals, but the divider cannot divide the input signal into three or five signals. Therefore, the above divider and the above divider circuit are not applicable to the array antenna having the odd-numbered radiation elements. For this reason, the divider that is applicable to the array antenna having the odd-numbered radiation elements and also capable of feeding a power to respective radiation elements at an in-phase and unbalanced power ratio such that the radiation characteristic of the array antenna shows the low side lobe level is desired.

It is an object of the present invention to provide an unequal three-way divider that divides an input signal into three in-phase signals in such a way that a power ratio is different between a center and both ends.

Means for Solving the Problems

The present invention provides an unequal three-way divider for dividing an input signal into three in-phase signals whose power ratio is different between a center and both ends, the unequal three-way divider including: an input terminal to which the input signal is input; three output terminals for outputting respective one of three-divided signals; and three transmission lines provided between the input terminal and the three output terminals, and branched from the input terminal and connected to the respective three output terminals, wherein: a transmission line connected to a center output terminal out of the three transmission lines has a first transmission line and a second transmission line whose electrical length is ¼ wave length, which are connected in series with each other; each of two transmission lines connected to the output terminals at both ends out of the three transmission lines has a third transmission line and a fourth transmission line whose electrical length is ¼ wave length, which are connected in series with each other; an absorption resistor is provided between a connection point between the first transmission line and the second transmission line and a connection point between the third transmission line and the fourth transmission line; and an electrical length of the first transmission line or the third transmission line is ¼ wave length.

In the unequal three-way divider, the transmission line connected to the center output terminal has a fifth transmission line connected in series with the second transmission line; each of the two transmission lines connected to the output terminals at both ends has a sixth transmission line connected in series with the fourth transmission line; and a relationship between a difference ΔL1 in electrical length between the first transmission line and the third transmission line and a difference ΔL2 in electrical length between the fifth transmission line and the sixth transmission line is set as ΔL2=−ΔL¼

In the unequal three-way divider, characteristic impedances of the transmission lines and a resistance value of the absorption resistor are given, in order to implement the power ratio of $1:k^2:1$ (k is a real number of 1 or more), by

[Formula 1]

$$Z_{12} = \sqrt{\left(\frac{k^2+2}{k^3}\right)} \cdot Z_{10}$$

$$Z_{13} = \sqrt{k} \cdot (k^2+2) \cdot Z_{10}$$

$$Z_{14} = \frac{Z_{10}}{\sqrt{k}}$$

$$Z_{15} = \sqrt{k} \cdot Z_{10}$$

$$R_{10} = \frac{2k^2+1}{2k} \cdot Z_{10}$$

where $Z_{10}$ is a characteristic impedance of each of the fifth transmission line and the sixth transmission line, $Z_{12}$ is a characteristic impedance of the first transmission line, $Z_{14}$ is a characteristic impedance of the second transmission line, $Z_{13}$ is a characteristic impedance of the third transmission line, $Z_{15}$ is a characteristic impedance of the fourth transmission line, and $R_{10}$ is a resistance value of the absorption resistor.

The unequal three-way divider further includes a seventh transmission line which is provided between the input terminal and the three transmission lines and whose electrical length is ¼ wave length, wherein: characteristic impedances of the transmission lines and a resistance value of the absorption resistor are given, in order to implement a power ratio of $1:k^2:1$ (k is a real number of 1 or more), by

[Formula 2]

$$Z_{21} = \left(\frac{k}{k^2+2}\right)^{\frac{1}{4}} \cdot Z_{10}$$

$$Z_{12} = \sqrt{\frac{(k^2+2)^{\frac{1}{4}}}{k^{\frac{5}{4}}}} \cdot Z_{10}$$

$$Z_{13} = k^{\frac{3}{4}} \cdot (k^2+2)^{\frac{1}{4}} \cdot Z_{10}$$

$$Z_{14} = \frac{Z_{10}}{\sqrt{k}}$$

$$Z_{15} = \sqrt{k} \cdot Z_{10}$$

$$R_{10} = \frac{2k^2+1}{2k} \cdot Z_{10}$$

where $Z_{10}$ is a characteristic impedance of each of the fifth transmission line and the sixth transmission line, $Z_{12}$ a the characteristic impedance of the first transmission line, $Z_{14}$ is a characteristic impedance of the second transmission line, $Z_{13}$ is a characteristic impedance of the third transmission line, $Z_{15}$ is a characteristic impedance of the fourth transmission line, $Z_{21}$ is a characteristic impedance of the seventh transmission line, and $R_{10}$ is a resistance value of the absorption resistor.

The present invention provides an antenna equipment, which includes the above unequal three-way divider; and an array antenna having three antenna elements connected to respective one of the three output terminals of the unequal three-way divider.

Advantages of the Invention

According to the unequal three-way divider of the present invention, the input signal can be divided into three in-phase signals. Also, since a power ratio is set differently between a center and both ends, the radiation characteristic whose side lobes are suppressed at a low level can be implemented when an array antenna having three antenna elements is connected to this unequal three-way divider.

DESCRIPTION OF REFERENCE NUMERALS AND SIGNS

11 input terminal
12 to 14 output terminal
M10, M12, M13*a*, M13*b*, M14, M15*a*, M15*b*, M16, M17*a*, M17*b*, M21 transmission line
R10*a*, R10*b* absorption resistor

BEST MODE FOR CARRYING OUT THE INVENTION

Embodiments of the present invention will be explained with reference to the drawings hereinafter.

First Embodiment

Figure 1:
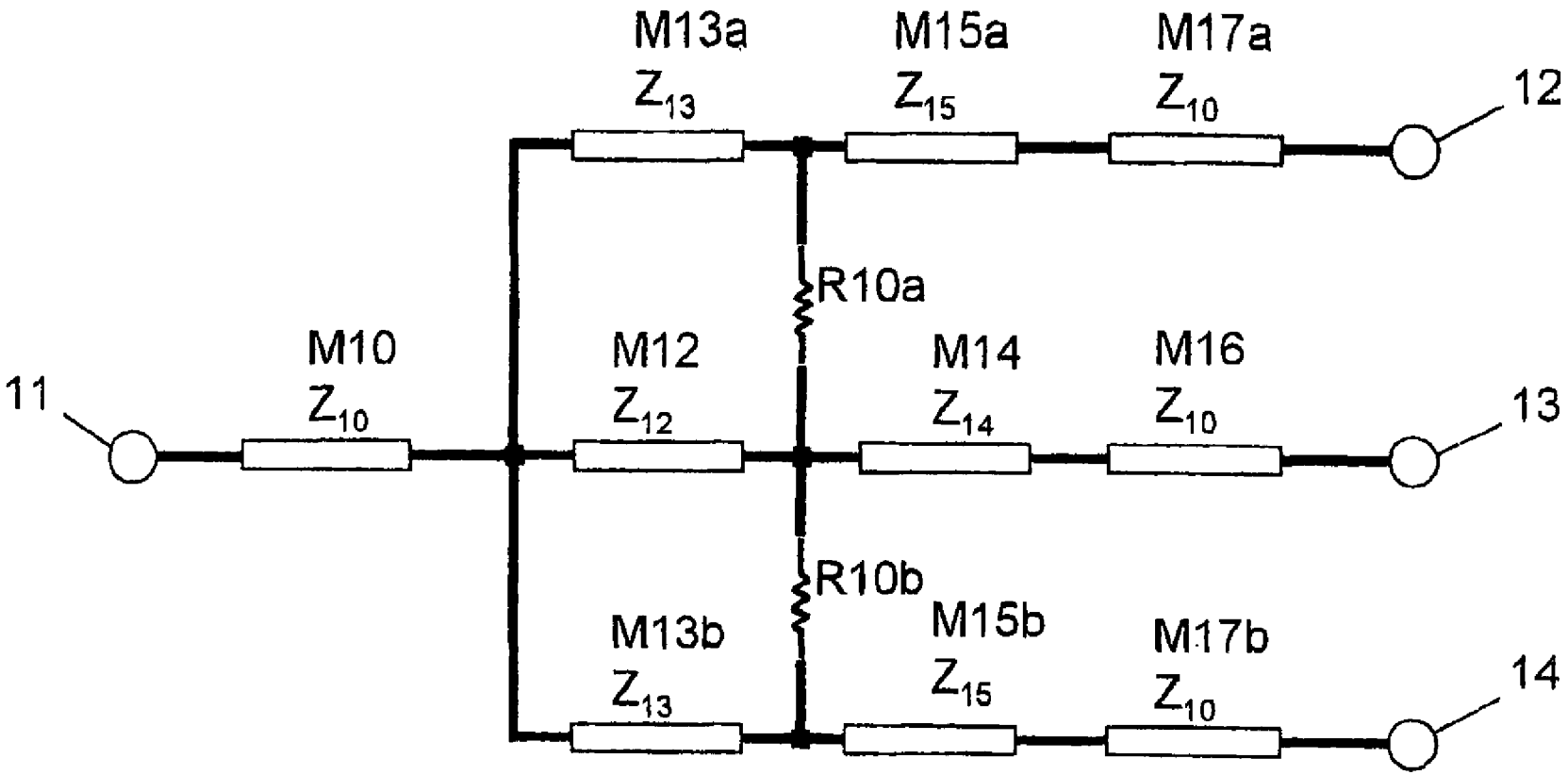
FIG. 1 is a block diagram showing an unequal three-way divider according to a first embodiment of the present invention.

FIG. 1 is a block diagram showing an unequal three-way divider according to a first embodiment of the present invention. As shown in FIG. 1, the unequal three-way divider of the first embodiment has an input terminal 11, transmission lines M10, M12, M13*a*, M13*b*, M14, M15*a*, M15*b*, M16, M17*a*, M17*b* as microstrip lines, absorption resistors R10*a*, R10*b*, and three output terminals 12 to 14. Radiation elements constituting an array antenna (not shown), or the like are connected to respective output terminals. As shown in FIG. 1, paths from the input terminal 11 to three output terminals 12 to 14 are branched into three paths at the succeeding stage of the transmission line M10.

Out of three branched paths, a center path is constructed by the transmission lines M12, M14, M16, one path of the paths provided to both sides is constructed by the transmission lines M13*a*, M15*a*, M17*a*, and the other path is constructed by the transmission lines M13*b*, M15*b*, M17*b*. Electrical lengths of the transmission lines M12, M14, M15*a*, M15*b* are set to ¼ wave length respectively. In the present embodiment, a high-frequency signal whose frequency is 5 GHz, for example, is input into the input terminal 11. The absorption resistor R10*a* is provided to connect a connection point between the transmission line M12 and the transmission line M14 and a connection point between the transmission line M13*a* and the transmission line M15*a*. Also, the absorption resistor R10*b* is provided to connect a connection point between the transmission line M12 and the transmission line M14 and a connection point between the transmission line M13*b* and the transmission line M15*b*.

Figure 2:
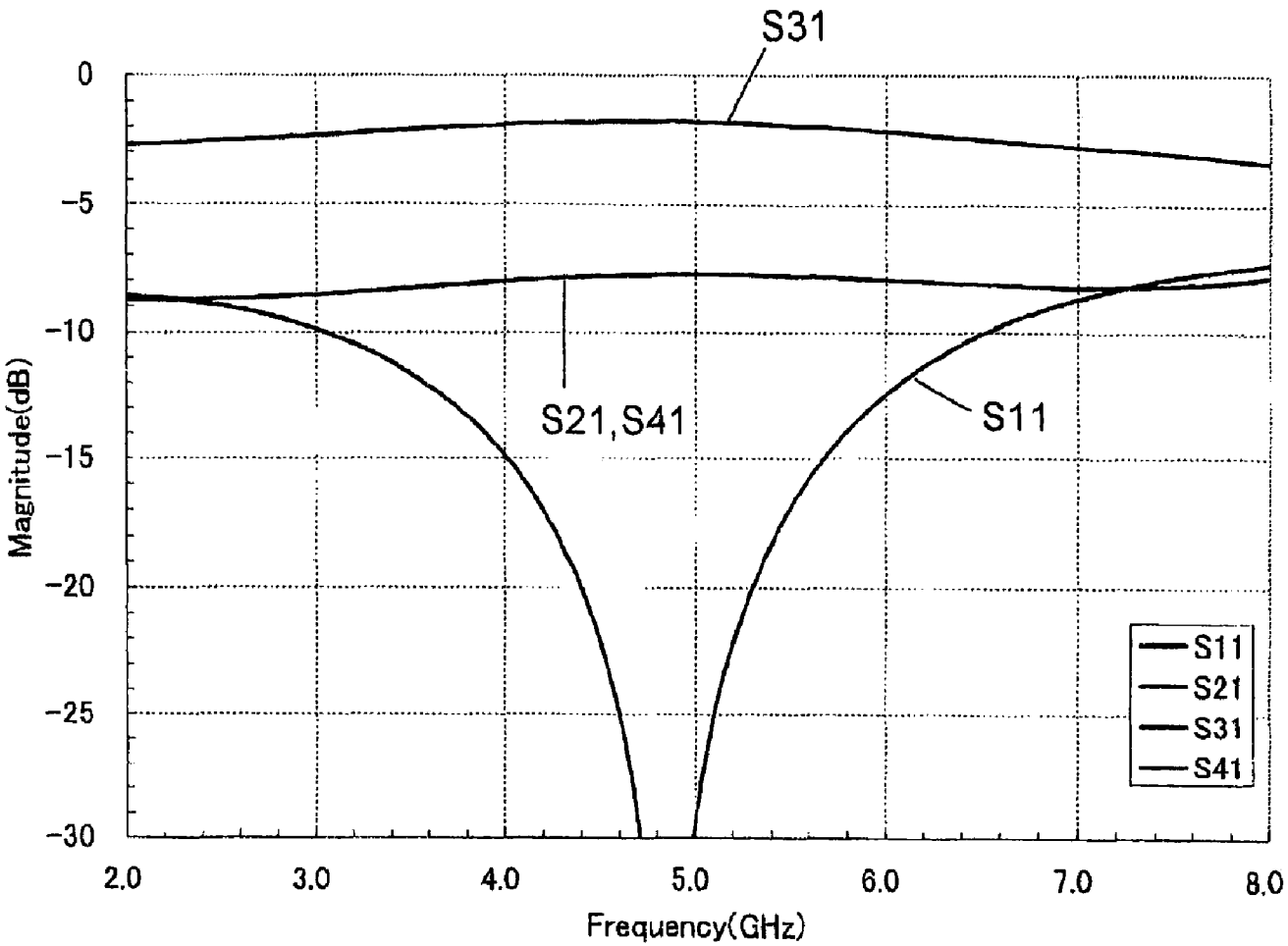
FIG. 2 shows a magnitude characteristic of output signals with respect to a frequency band.

Assume that a characteristic impedance of the transmission lines M10, M16, M17*a*, M17*b* is $Z_{10}$ respectively, a characteristic impedance of the transmission line M12 is $Z_{12}$, a characteristic impedance of the transmission lines M13*a*, M13*b* is $Z_{13}$ respectively, a characteristic impedance of the transmission line M14 is $Z_{14}$, a characteristic impedance of the transmission line M15*a*, M15*b* is $Z_{15}$ respectively, and a resistance value of the absorption resistors R10*a*, R10*b* is R10 respectively. In order to supply a power of $k^2$ (k is a real number of 1 or more) to the center path, i.e., to implement a power ratio of $1:k^2:1$, the characteristic impedances and the absorption resistances of respective transmission lines must have the relationships given in the following on the assumption that a power supplied to the paths on both sides of three paths respectively is set to 1. Here, the recitations on pages 91, 92 of Non-Patent Literature 2 can be referred to in deriving the following mathematical expressions. In this Literature, an example of the two-way power division is explained. In this case, when the divider shown in FIG. 2 is modified into the three-way divider whose power ratio is set to $1:k^2:1$, the three-way power division may be derived similarly to Equations (1) to (3) and Equation in FIG. 2.

[Formula 3]

$$Z_{12} = \sqrt{\left(\frac{k^2+2}{k^3}\right)} \cdot Z_{10}$$

$$Z_{13} = \sqrt{k \cdot (k^2+2)} \cdot Z_{10}$$

$$Z_{14} = \frac{Z_{10}}{\sqrt{k}}$$

$$Z_{15} = \sqrt{k} \cdot Z_{10}$$

$$R_{10} = \frac{2k^2+1}{2k} \cdot Z_{10}$$

When $Z_{10}$=50.00Ω is set, in order to implement the unequal three-way divider whose power ratio is set to $1:k^2:1$, $Z_{12}$=43.30Ω
$Z_{13}$=173.21Ω
$Z_{14}$=35.36Ω
$Z_{15}$=70.71Ω
$R_{10}$=112.50Ω are needed.

Figure 3:
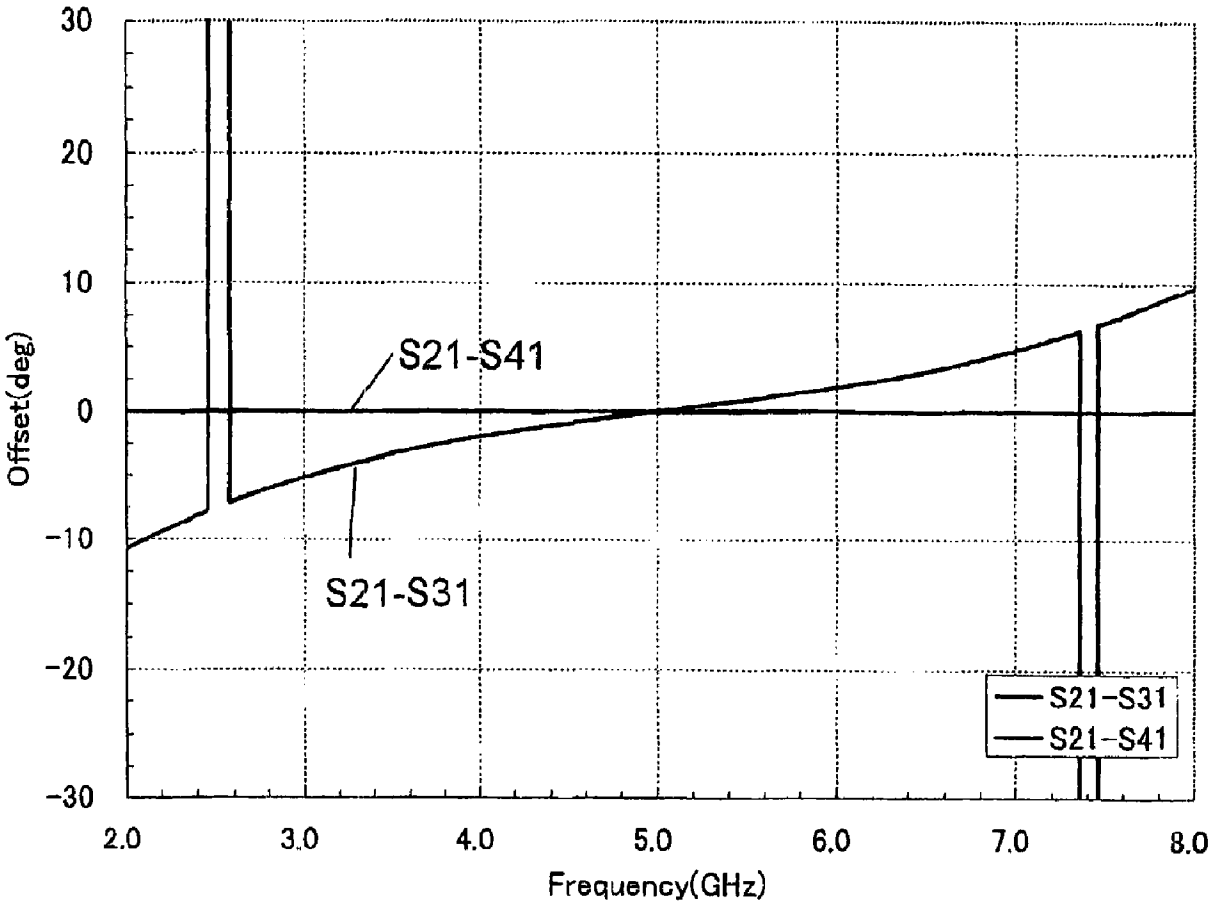
FIG. 3 shows an offset between output ports with respect to the frequency band.

FIG. 2 and FIG. 3 show simulated results of the outputs when a signal of a frequency of 5 GHz is input into the input terminal 11, in the unequal three-way divider of the present embodiment explained above. In this simulation, respective electrical lengths of the transmission lines M13*a*, M13*b* provided to the unequal three-way divider are set to ¼ wave length.

FIG. 2 shows a magnitude characteristic of output signals with respect to a frequency band. A reference symbol S31 in FIG. 2 denotes a signal that is output from the output terminal via the center path. Reference symbols S21, S41 in FIG. 2 denote a signal that is output from the output terminal via one of both side paths respectively. A reference symbol S11 in FIG. 2 denotes a reflected signal that is output from the input terminal 11. As shown in FIG. 2, a magnitude of the signal S31 at 5 GHz is −1.76 dB, and magnitudes of the signals S21, S41 are −7.78 dB, so that there is an offset of about 6 dB between the signal S31 and the signals S21, S41. Therefore, it is understood that a power ratio is set to 1:4:1.

FIG. 3 shows an offset between output ports with respect to the frequency band. A reference symbol S21-S31 in FIG. 3 denotes an offset of the signal being output from the output terminal via one of both side paths to the signal being output via the center path. A reference symbol S21-S41 in FIG. 3 denotes an offset between two signals being output from the output terminals via both side paths. As shown in FIG. 3, the offset S21-S31 is within 10° in a frequency band of 3 to 7 GHz. As a result, the unequal three-way divider of the present embodiment can be used over a wide band.

Figure 4:
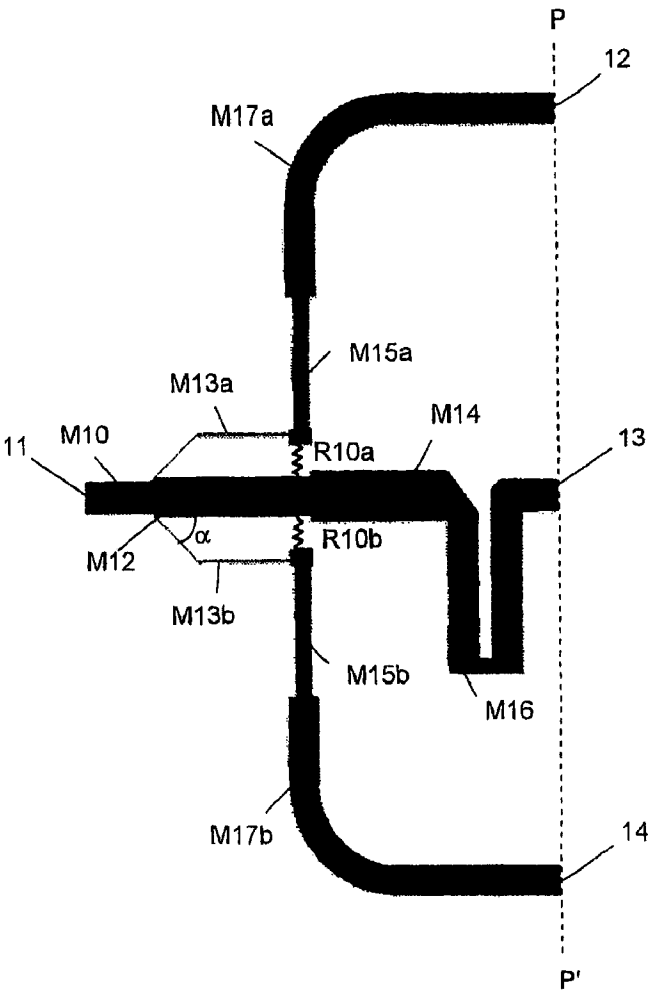
FIG. 4 shows a pattern of the unequal three-way divider according to the first embodiment configured on a printed board.

An example in which the unequal three-way divider of the present embodiment is configured on a printed board will be explained hereunder. FIG. 4 shows a pattern of the unequal three-way divider of the first embodiment configured on the printed board. As shown in FIG. 4, three output terminals 12 to 14 are aligned on the same straight line (P-P'). It is desirable that an electrical length of the transmission line M12 and electrical lengths of the transmission lines M13*a*, M13*b* should be set to ¼ wave length respectively. However, as shown in FIG. 4, even though the absorption resistors R10*a*, R10*b* are formed of a chip resistor respectively, it is impossible to neglect these resistances. Therefore, it is unfeasible in design to set the electrical length of the transmission line M12 and the electrical lengths of the transmission lines M13*a*, M13*b* to the same length respectively. For this reason, in the present embodiment, in order to cancel the offset generated due to a difference in line lengths between the transmission line M12 and the transmission lines M13*a*, M13*b*, a difference is provided between the line length of the transmission line M16 and the line lengths of the transmission lines M17*a*, M17*b*.

Assume that an electrical length of the transmission line M12 is L12, respective electrical lengths of the transmission lines M13*a*, M13*b* are L13, and L12−L13=ΔL1. Also, the electrical length of the transmission line M16 is L16, respective electrical lengths of the transmission lines M17*a*, M17*b* are L17, and L16−L17=ΔL2. In this case, respective transmission lines are designed to satisfy the relationship of ΔL2=−ΔL¼. In this manner, the offset between the signals being output from three output terminals can be reduced due to the difference of the line length between the transmission line M16 and the transmission lines M17*a*, M17*b*.

For example, when the electrical length of the transmission lines M12, M14, and M15 is λ/4 (=90°) at 5 GHz and also the electrical length of the transmission line M13 is 100°, a difference ΔL1 (=L12−L13) between the electrical length L2 of the transmission line M12 and the electrical length L3 of the transmission line M13 is −10°. In order to cancel the offset generated in this portion, a difference ΔL2 between the electrical length L16 of the transmission line M16 and the electrical length L17 of the transmission line M17 must be given as follows:

$$\Delta L2 = L16 - L17 = -\Delta L\tfrac{1}{4} = 2.5^\circ$$

For this purpose, in the present embodiment, the electrical length L16 of the transmission line M16 is set to 90° and the electrical length L17 of the transmission line M17 is set 87.5°.

When a dielectric constant ∈r=2.6 of the printed board, a dielectric loss tangent tan δ=0.0015, and a thickness t=0.8 mm of the printed board are set respectively, line widths of respective transmission lines are given as follows:

M10=2.2 mm
M12=2.7 mm
M13*a*, M13*b*=0.3 mm
M14=3.6 mm
M15*a*, M15*b*=1.2 mm
M16=2.2 mm
M17*a*, M17*b*=2.2 mm

Also, when an angle α between the transmission line M12 and the transmission lines M13*a*, M13*b* is 45° and the chip resistor of a 3216 size as the absorption resistors R10*a*, R10*b*, a difference ΔL1 (=L12−L13) between the electrical length of the transmission line M12 and the electrical length of the transmission lines M13*a*, M13*b* is −1.3 mm. This difference of 1.3 mm produces the offset of about 11° at 5 GHz. As described above, in order to reduce this offset, a difference ΔL2 (=L16−L17) is provided between the electrical length of the transmission line M16 and the electrical length of the transmission lines M17*a*, M17*b*. Since ΔL2=−L¼ is satisfied, ΔL2=1.3 mm/4=0.325 mm.

Figure 5:
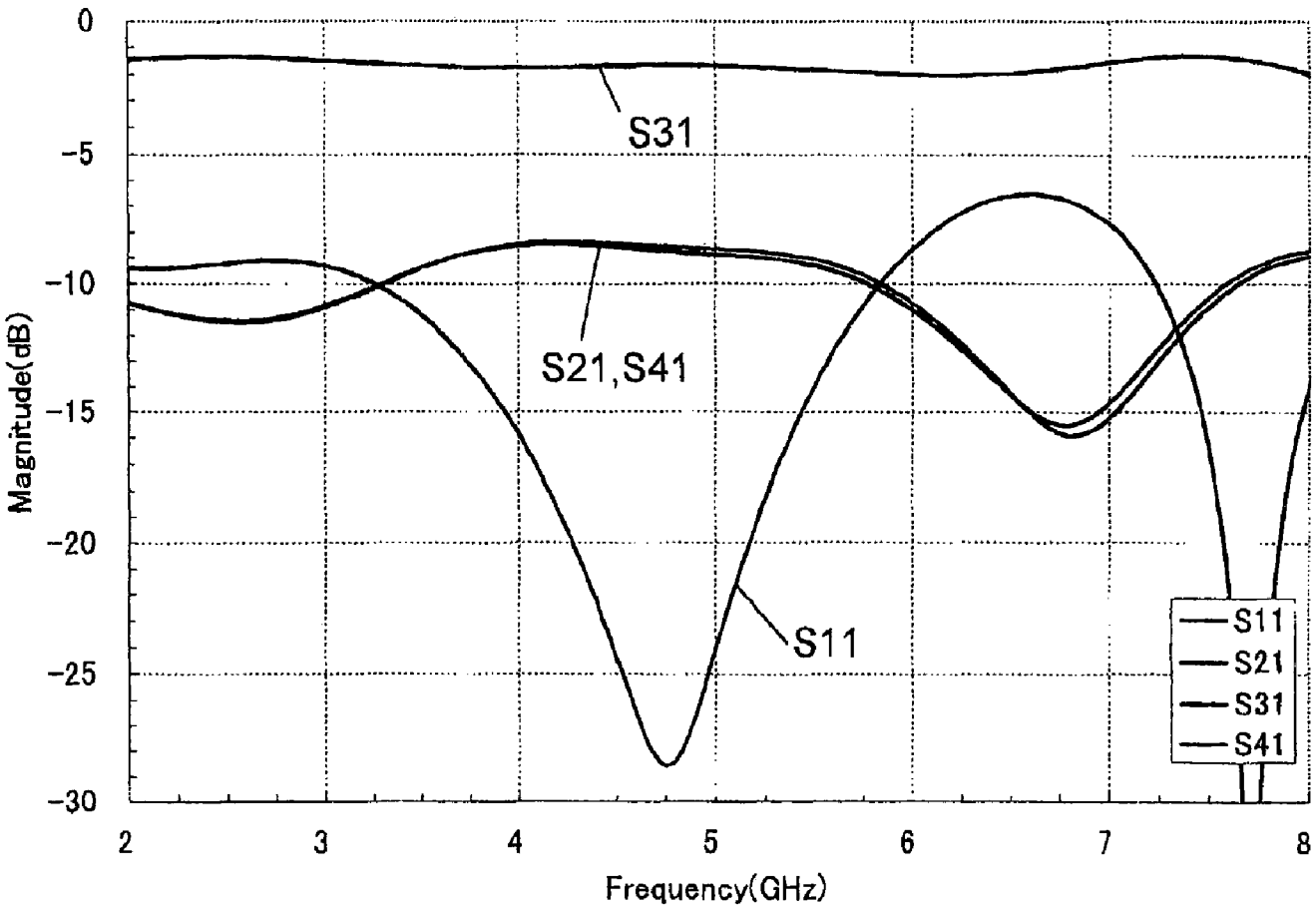
FIG. 5 shows a magnitude characteristic of output signals with respect to the frequency band.
Figure 6:
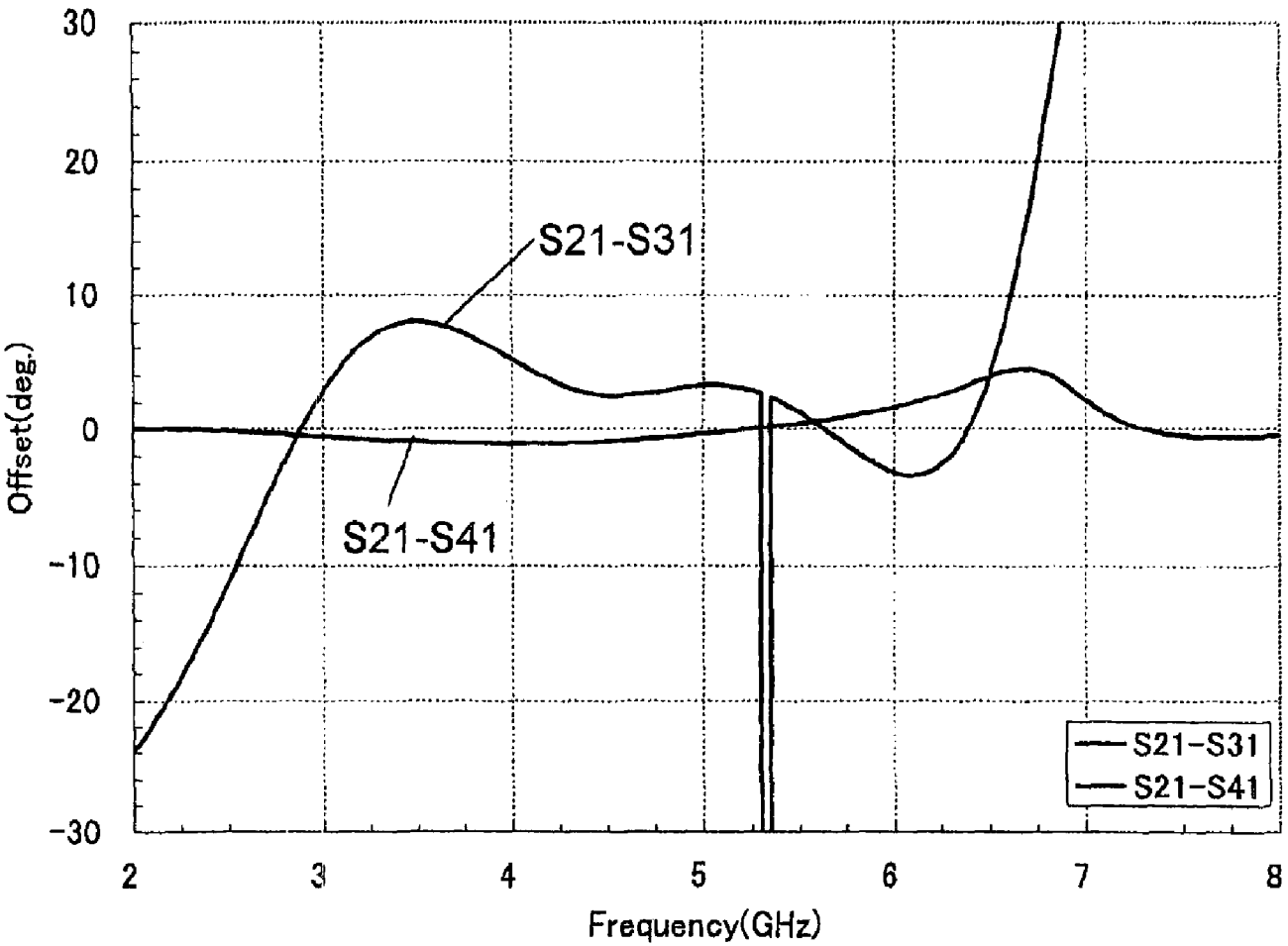
FIG. 6 shows an offset between output ports with respect to the frequency band.

FIG. 5 and FIG. 6 show simulated results of the outputs when a signal of a frequency of 5 GHz is input into the input terminal 11, in the unequal three-way divider constructed on the printed board explained above. FIG. 5 shows a magnitude characteristic of output signals with respect to the frequency band. A reference symbol S31 in FIG. 5 denotes a signal that is output from the output terminal via the center path. Reference symbols S21, S41 in FIG. 5 denote a signal that is output from the output terminal via one of both side paths respectively. A reference symbol S11 in FIG. 5 denotes a reflected signal that is output from the input terminal 11. As shown in FIG. 5, a magnitude of the signal S31 at 5 GHz is −1.68 dB, and magnitudes of the signals S21, S41 are −8.70 dB, so that there is an offset of about 7 dB between the signal S31 and the signals S21, S41. Therefore, it is understood that a power ratio is set substantially to 1:4:1.

FIG. 6 shows an offset between output ports with respect to the frequency band. A reference symbol S21-S31 in FIG. 6 denotes an offset of the signal being output from the output terminal via one of both side paths to the signal being output via the center path. A reference symbol S21-S41 in FIG. 6 denotes an offset between two signals being output from the output terminals via both side paths. Although the signal S21 and the signal S41 are slightly different in characteristic because of the influence of a folded portion of the transmission line M16, the direction characteristic of the array antenna is not largely influenced since the offset between the signal S21 and the signal S41 in the frequency band of 4 to 6 GHz is within 0.5 dB, as shown in FIG. 5. As shown in FIG. 6, the offset S21-S31 is within 10° in a frequency band of 3 to 6 GHz, and the offset S21-S41 is within 1°. As a result, the unequal three-way divider of the present embodiment can be used over a wide band.

As described above, according to the unequal three-way divider of the present embodiment, the divider that divides the input signal from the input terminal 11 into three in-phase signals in such a way that a power ratio is different between the center and both ends like $1:k^2:1$ (k is a real number of 1 or more) can be provided. In this manner, since the power of the signal being output from the center output terminal can be set larger than the power of the signals being output from the output terminals at both ends, the radiation characteristic with side lobes at a low level can be implemented when the array antenna having three radiation elements is connected to this divider.

Figure 7:
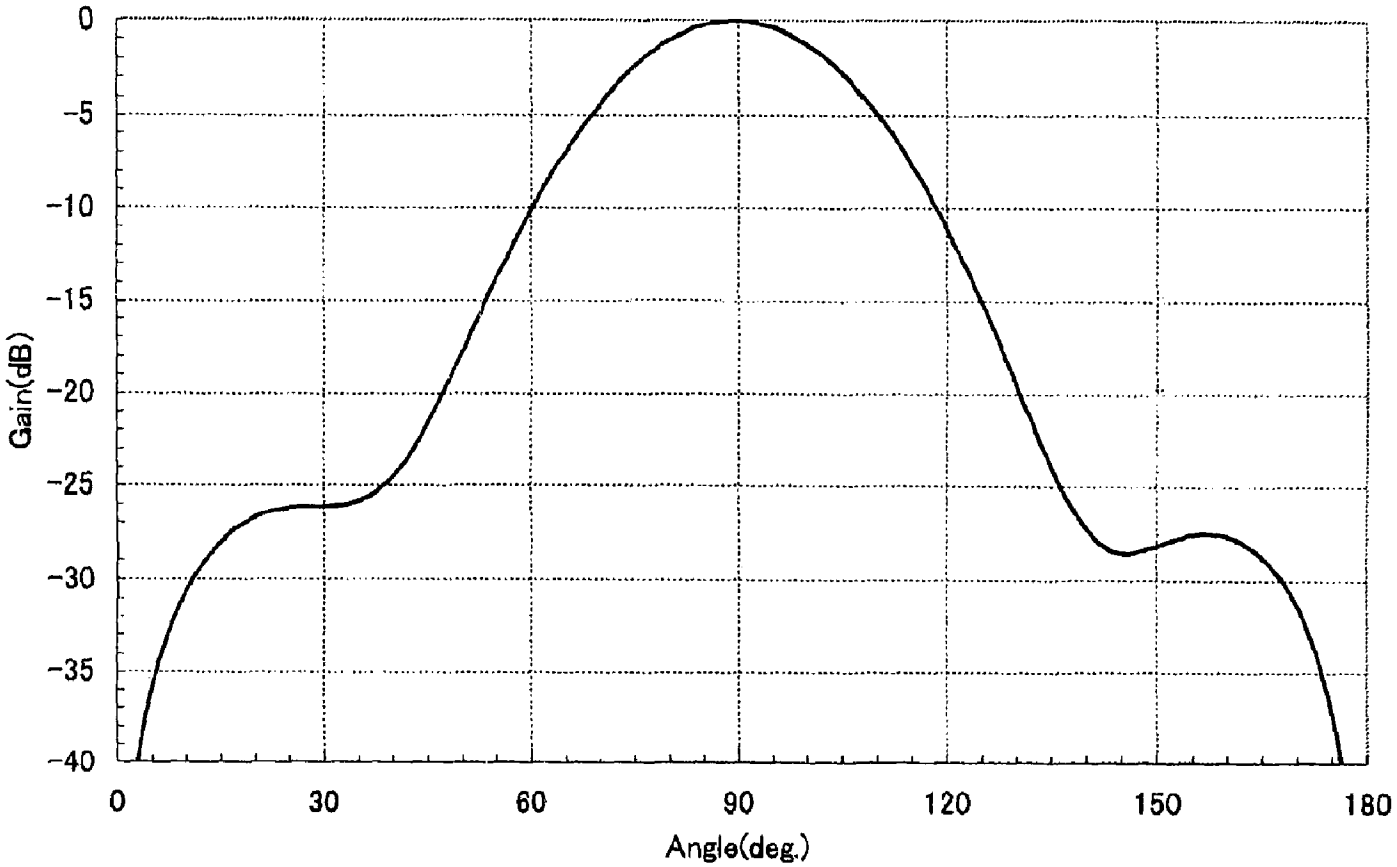
FIG. 7 shows a radiation characteristic of an array antenna connected to the unequal three-way divider whose power ratio is set 1:4:1 of the first embodiment.
Figure 8:
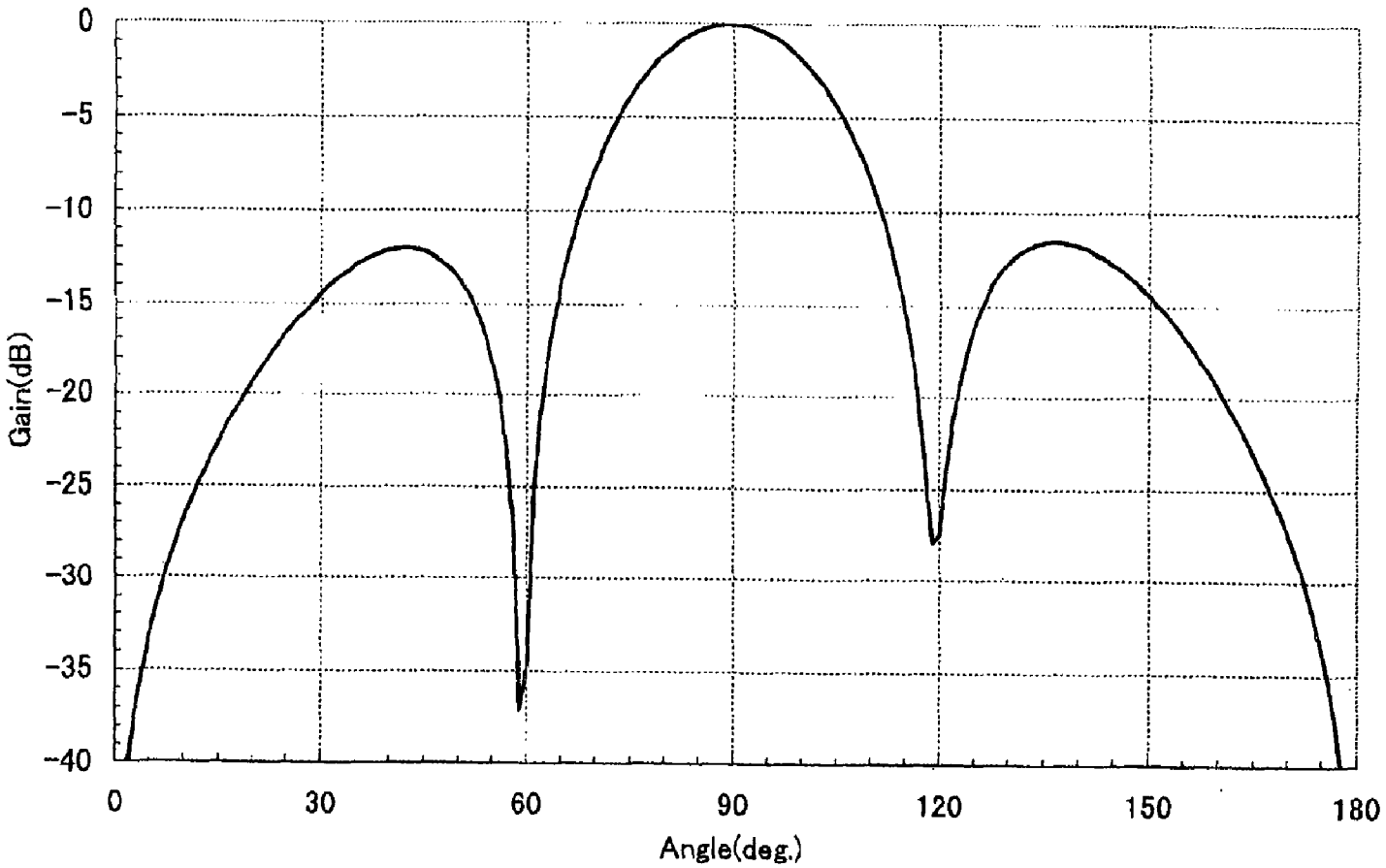
FIG. 8 shows a radiation characteristic of an array antenna connected to the unequal three-way divider whose power ratio is set 1:1:1 of the first embodiment.

For example, FIG. 7 shows a radiation characteristic of the array antenna connected to the unequal three-way divider whose power ratio is set 1:4:1 of the present embodiment. In contrast, FIG. 8 shows a radiation characteristic of the array antenna connected to the unequal three-way divider whose power ratio is set 1:1:1 of the present embodiment. The side lobe level shown in FIG. 8 is about −12 dB, while the side lobe level shown in FIG. 7 is about −26 dB. In this way, the side lobe level can be reduced largely by feeding the power to respective elements at any ratio.

Second Embodiment

Figure 9:
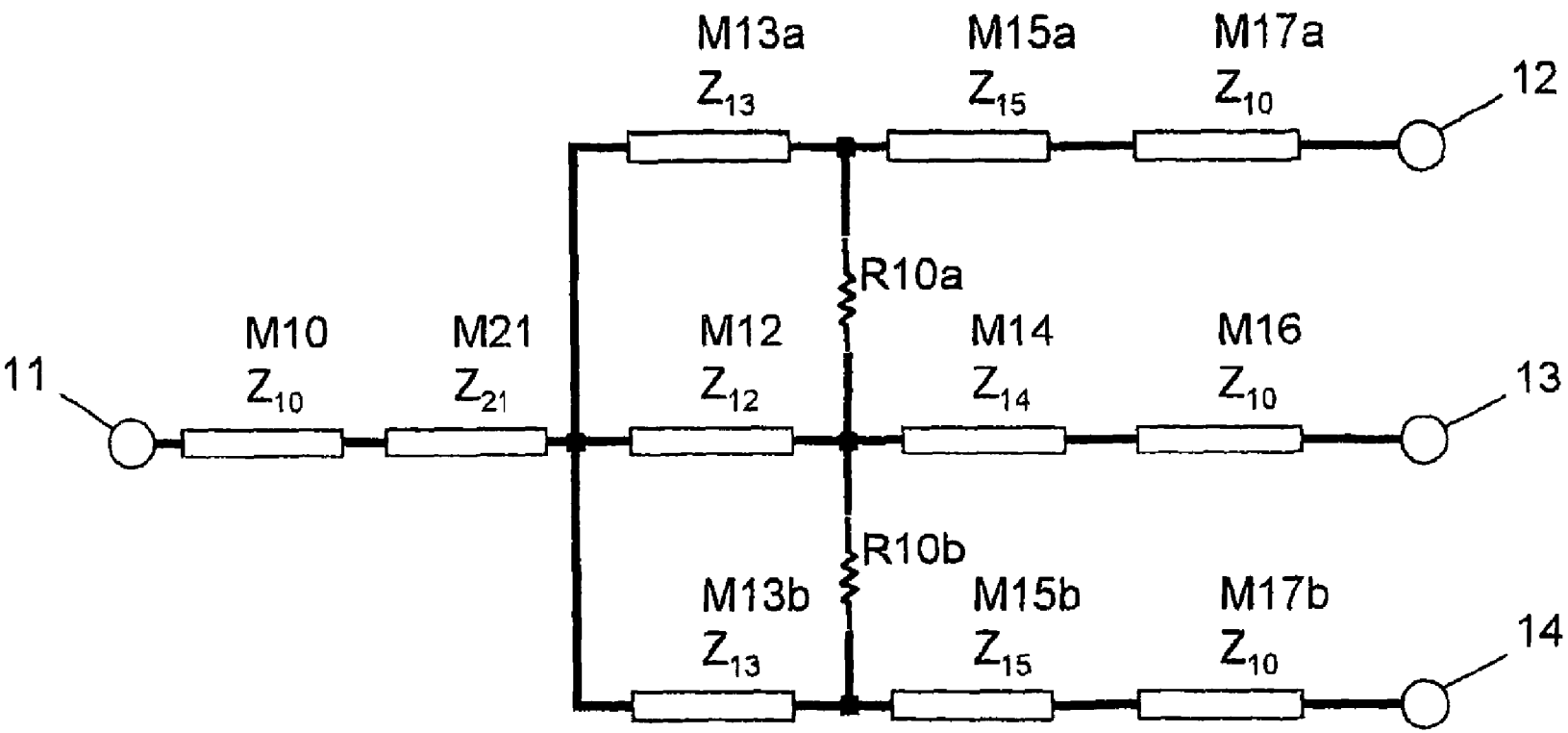
FIG. 9 is a block diagram showing an unequal three-way divider according to a second embodiment of the present invention.

FIG. 9 is a block diagram showing an unequal three-way divider according to a second embodiment of the present invention. A difference of the unequal three-way divider of the second embodiment from the unequal three-way divider of the first embodiment is that a transmission line M21 is added to a branch point from the transmission line M10 to the transmission lines M12, M13*a*, M13*b*. The second embodiment is similar to the first embodiment except this respect. In FIG. 9, the same reference symbols are affixed to the constituent elements common to those in FIG. 1.

The transmission line M21 is a microstrip line, and has an electrical length of ¼ wave length. In order to implement a power ratio of $1:k^2:1$, when a characteristic impedance of the transmission line M21 is $Z_{21}$, the characteristic impedances and the absorption resistances of respective transmission lines must have the relationships given in the following.

[Formula 4]

$$Z_{21} = \left(\frac{k}{k^2+2}\right)^{\frac{1}{4}} \cdot Z_{10}$$

$$Z_{12} = \frac{(k^2+2)^{\frac{1}{4}}}{k^{\frac{5}{4}}} \cdot Z_{10}$$

$$Z_{13} = k^{\frac{3}{4}} \cdot (k^2+2)^{\frac{1}{4}} \cdot Z_{10}$$

$$Z_{14} = \frac{Z_{10}}{\sqrt{k}}$$

$$Z_{15} = \sqrt{k} \cdot Z_{10}$$

$$R_{10} = \frac{2k^2+1}{2k} \cdot Z_{10}$$

When $Z_{10}$=50.00Ω is set, in order to implement the unequal three-way divider whose power ratio is set to $1:k^2:1$, $Z_{21}$=37.99Ω
$Z_{12}$=32.90Ω
$Z_{13}$=131.61Ω
$Z_{14}$=35.36Ω
$Z_{15}$=70.71Ω
$R_{10}$=112.5Ω are needed.

Figure 10:
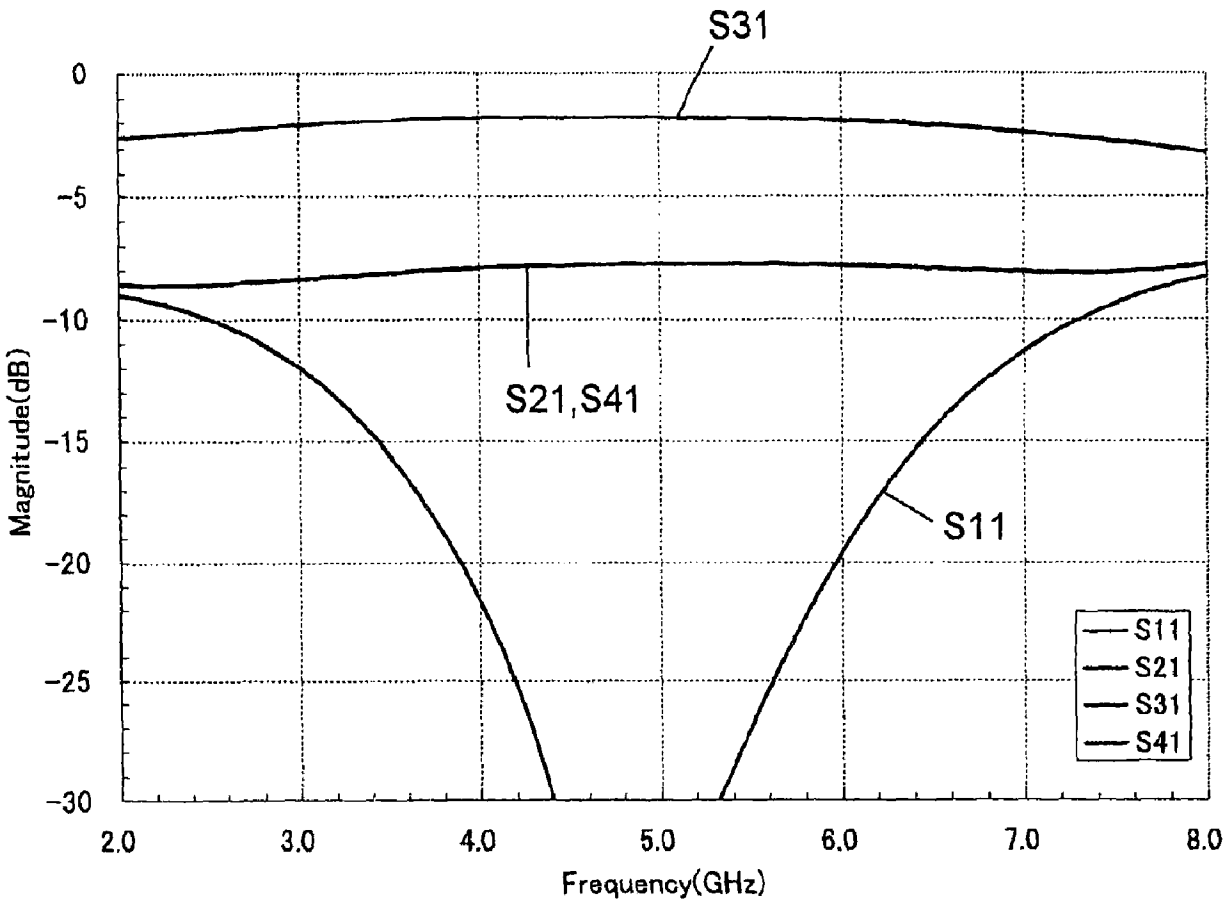
FIG. 10 shows a magnitude characteristic of output signals with respect to the frequency band.
Figure 11:
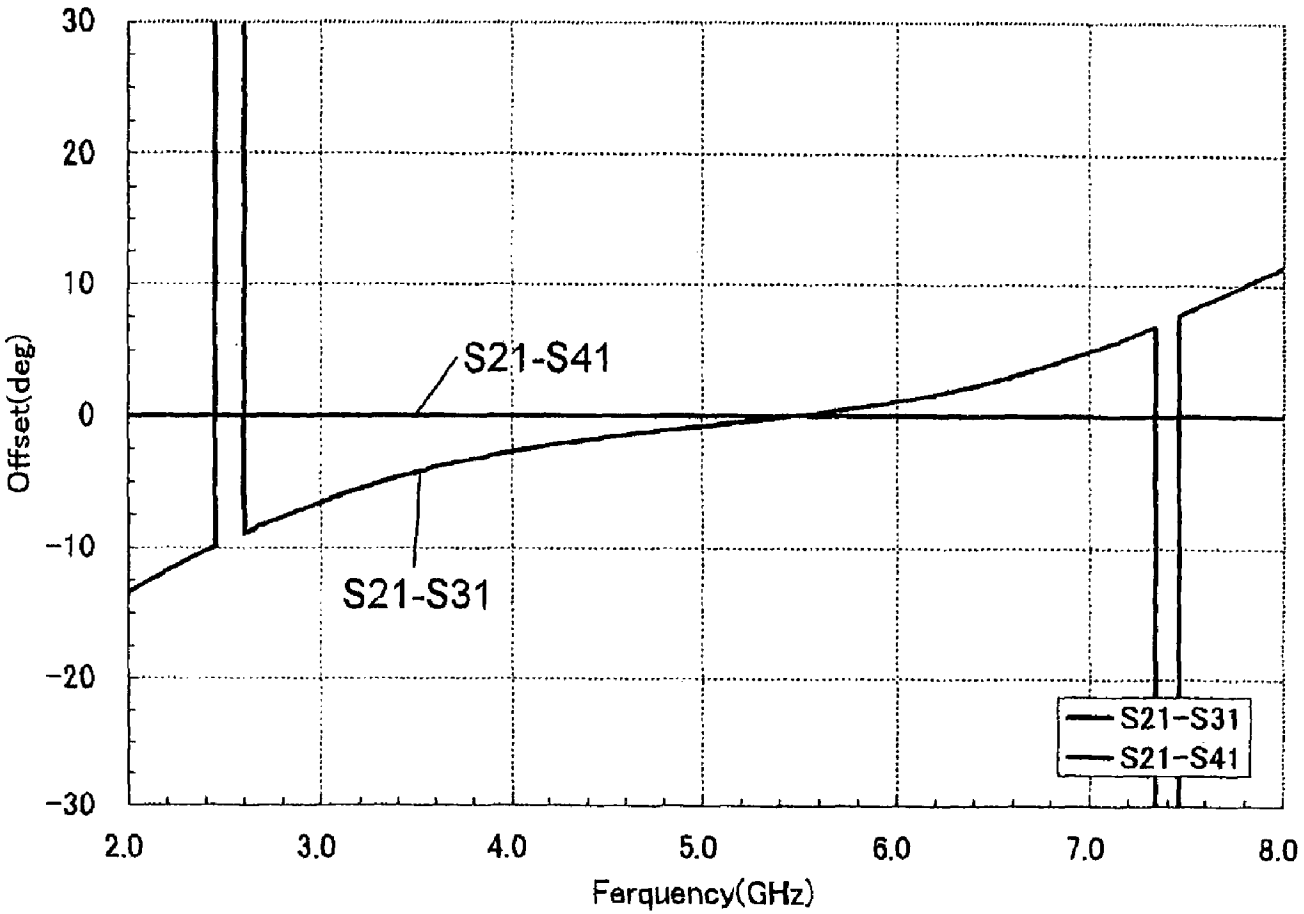
FIG. 11 shows an offset between output ports with respect to the frequency band.

FIG. 10 and FIG. 11 show simulated results of the outputs when a signal of a frequency of 5 GHz is input into the input terminal 11, in the unequal three-way divider of the present embodiment explained above. In this simulation, respective electrical lengths of the transmission lines M13*a*, M13*b* provided to the unequal three-way divider are also set to ¼ wave length. FIG. 10 shows a magnitude characteristic of output signals with respect to the frequency band. A difference of the magnitude characteristic shown in FIG. 10 from the magnitude characteristic shown in FIG. 2 in the first embodiment is that the level of the reflected signal denoted by the reference symbol S11 is low around a center frequency (5 GHz). Also, a variation in magnitude of the signals denoted by the reference symbols S21, S31, S41 is small. FIG. 11 shows an offset between output ports with respect to the frequency band. There is no particular difference of the offset from the first embodiment.

Figure 12:
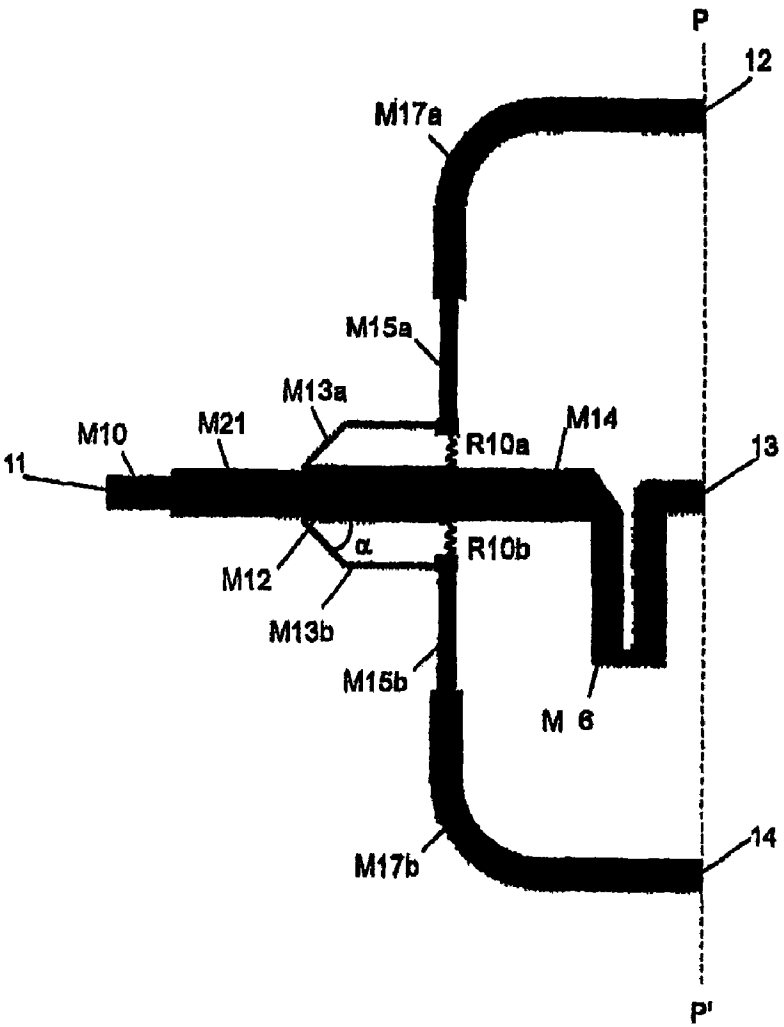
FIG. 12 shows a pattern of the unequal three-way divider according to the second embodiment configured on a printed board.

An example in which the unequal three-way divider of the present embodiment is constructed on the printed board will be explained hereunder. FIG. 12 shows a pattern of the unequal three-way divider of the second embodiment constructed on the printed board. When a dielectric constant ∈r=2.6 of the printed board, a dielectric loss tangent tan δ=0.0015, and a thickness t=0.8 mm of the printed board are set respectively, line widths of respective transmission lines are given as follows:

M10=2.2 mm
M21=3.3 mm
M12=4.0 mm
M13*a*, M13*b*=0.3 mm
M14=3.6 mm
M15*a*, M15*b*=1.2 mm
M16=2.2 mm
M17*a*, M17*b*=2.2 mm

Figure 13:
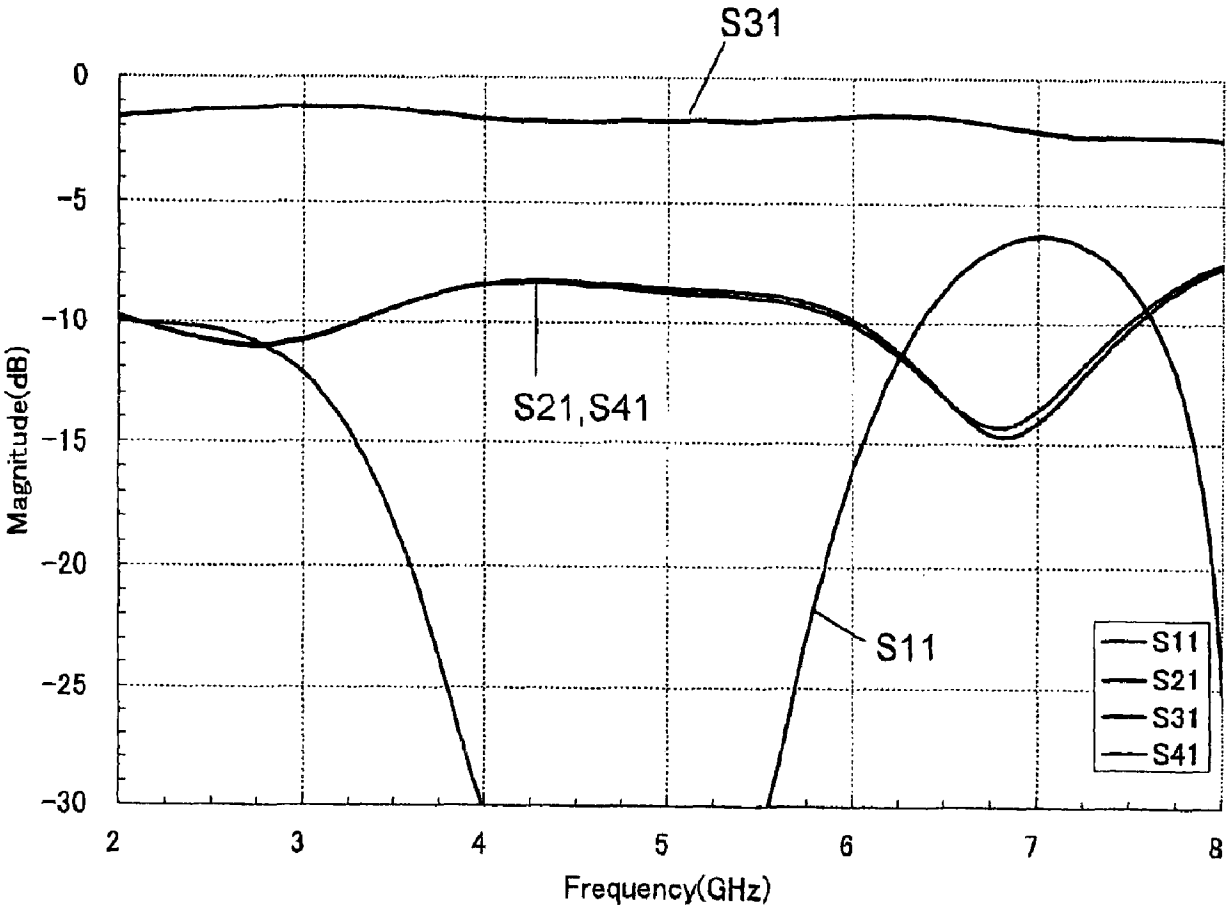
FIG. 13 shows a magnitude characteristic of output signals with respect to the frequency band.
Figure 14:
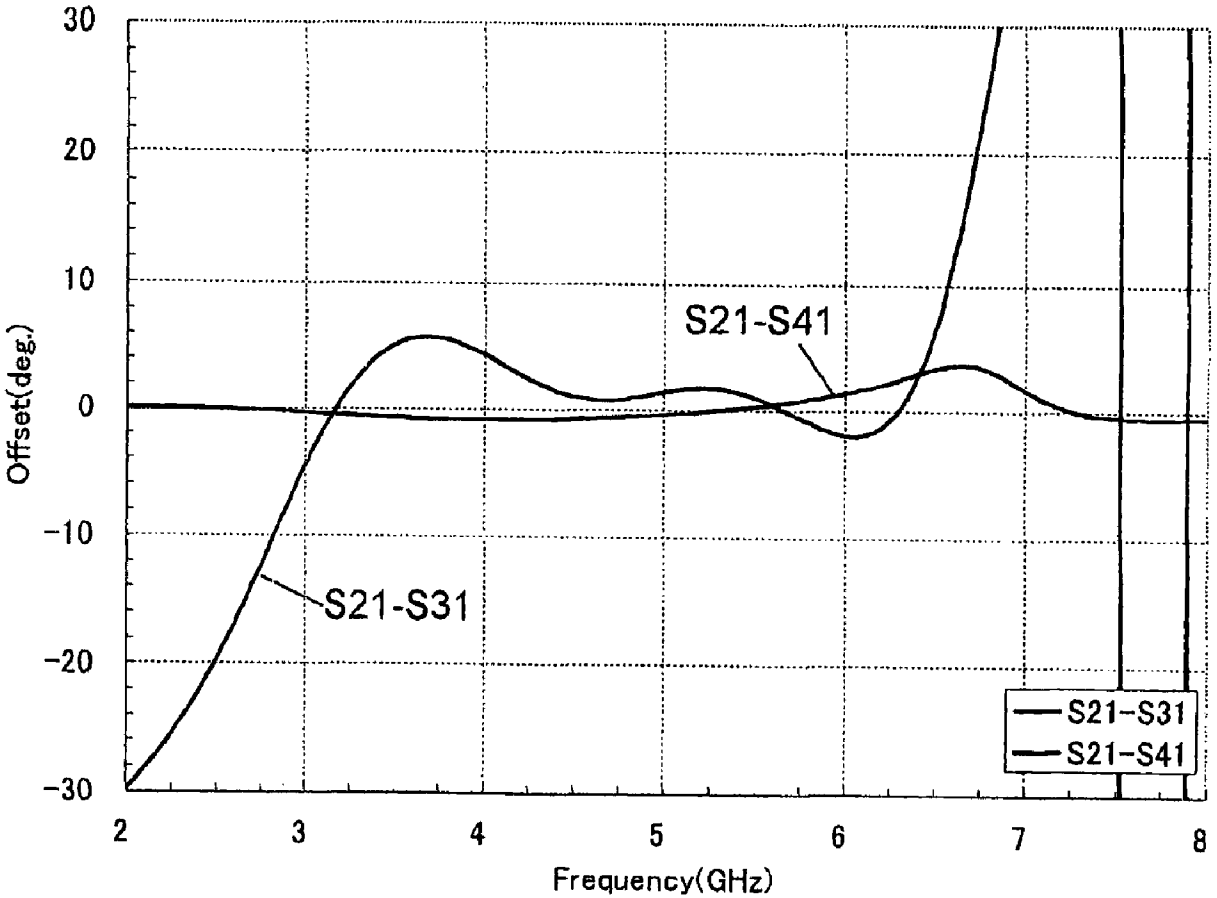
FIG. 14 shows an offset between output ports with respect to the frequency band.

FIG. 13 and FIG. 14 are views showing simulated results of the outputs when a signal of a frequency of 5 GHz is input into the input terminal 11, in the unequal three-way divider constructed on the printed board explained above. FIG. 13 shows a magnitude characteristic of output signals with respect to the frequency band. A difference of the magnitude characteristic shown in FIG. 13 from the magnitude characteristic shown in FIG. 5 in the first embodiment is that the level of the reflected signal denoted by the reference symbol S11 is low around a center frequency (5 GHz). Also, a variation in magnitude of the signals denoted by the reference symbols S21, S31, S41 is small. FIG. 14 shows an offset between output ports with respect to the frequency band. There is no particular difference of the offset from the first embodiment.

As explained above, according to the unequal three-way divider of the present invention, the reflected signal to the input terminal side can be suppressed. Also, a variation in magnitude of the signal being output from the output terminal can be made small.

Figure 15:
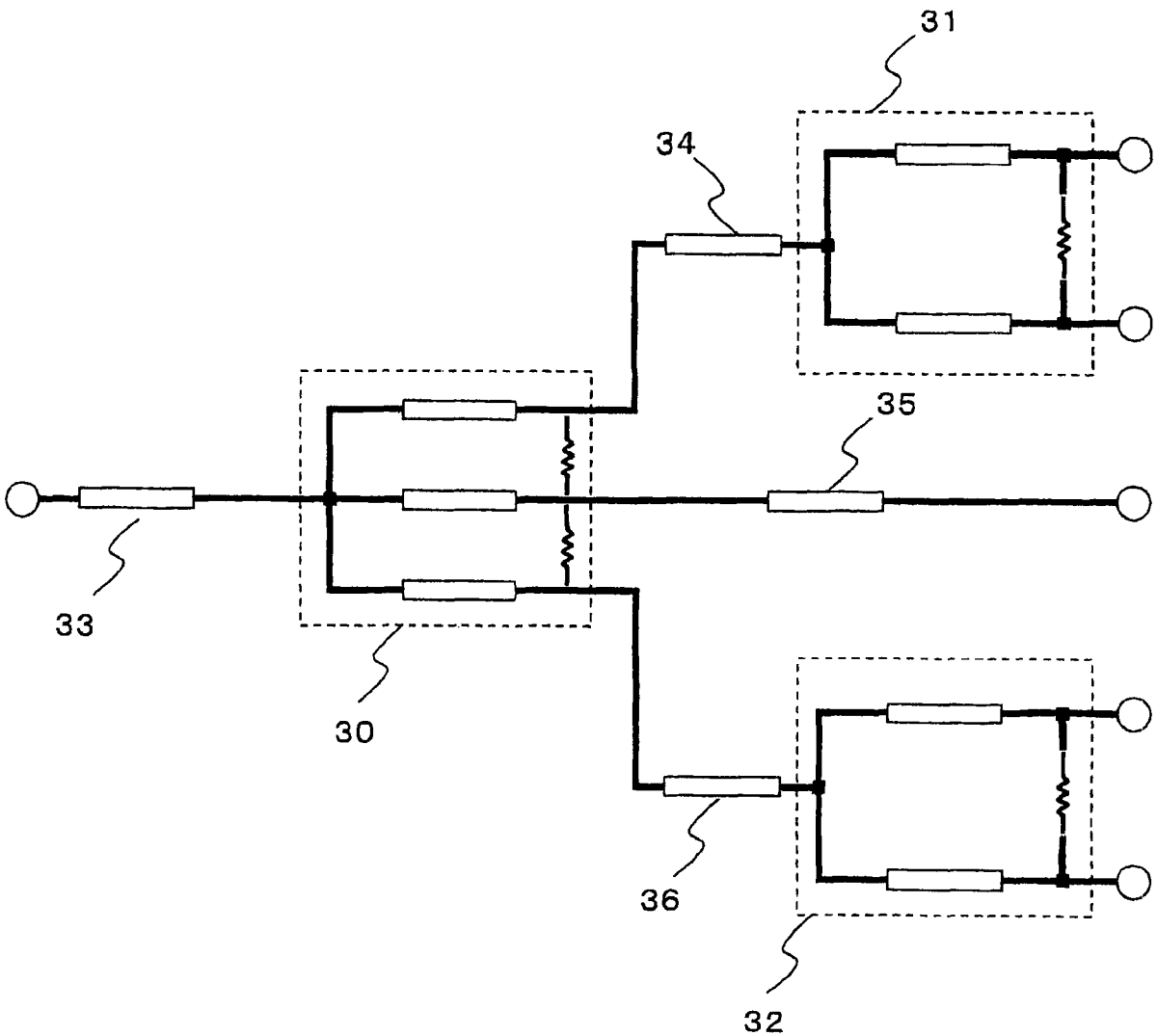
FIG. 15 shows a five-way divider equipped with the unequal three-way divider and an unequaled two-way divider according to the present invention.
Figure 16:
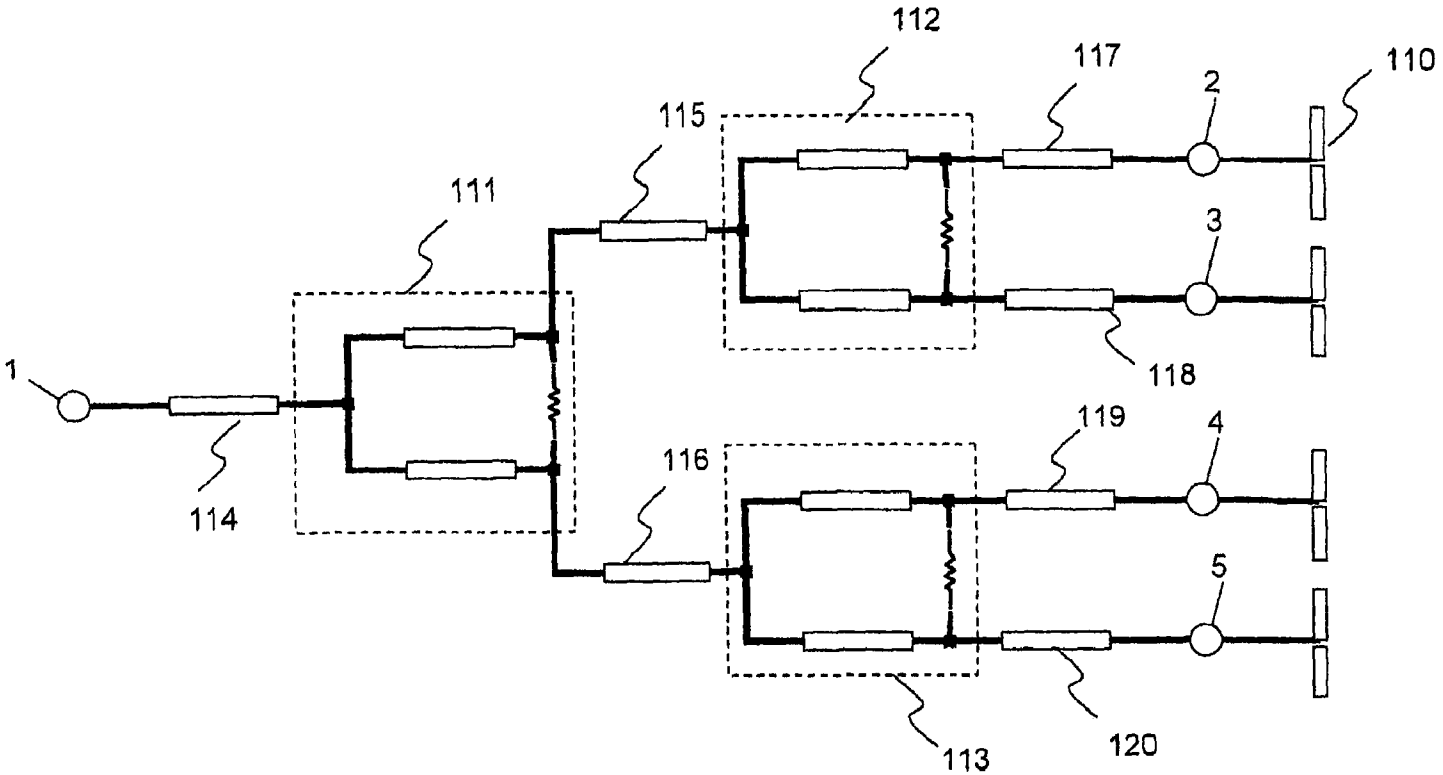
FIG. 16 shows an array antenna with four radiation elements and a four-way divider.
Figure 17:
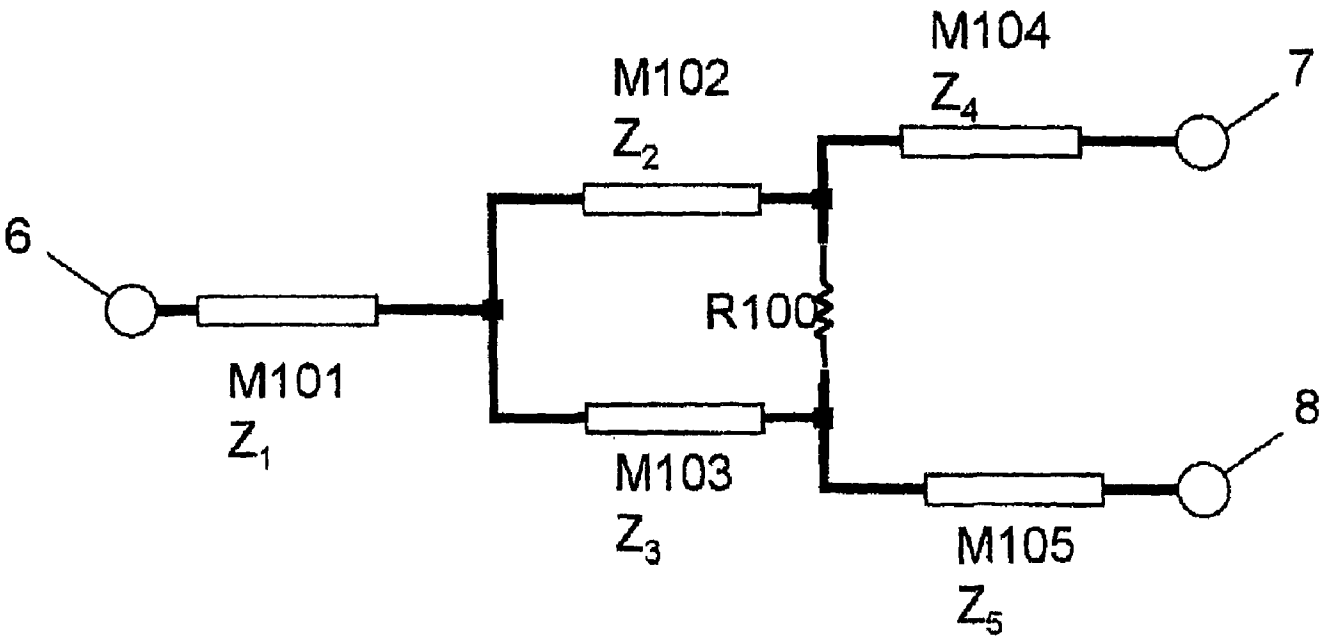
FIG. 17 shows a configuration of a Wilkinson-type two-way divider provided to the four-way divider shown in FIG. 16.
Figure 18:
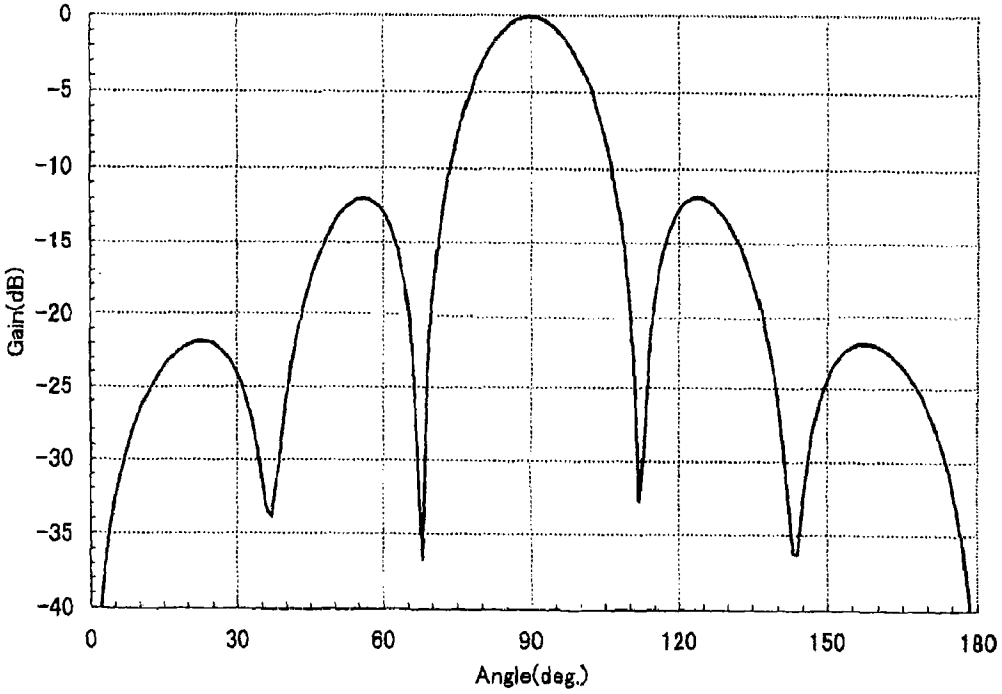
FIG. 18 shows a radiation characteristic of an array antenna when a power on an equal level is supplied to four radiation elements shown in FIG. 16 respectively.
Figure 19:
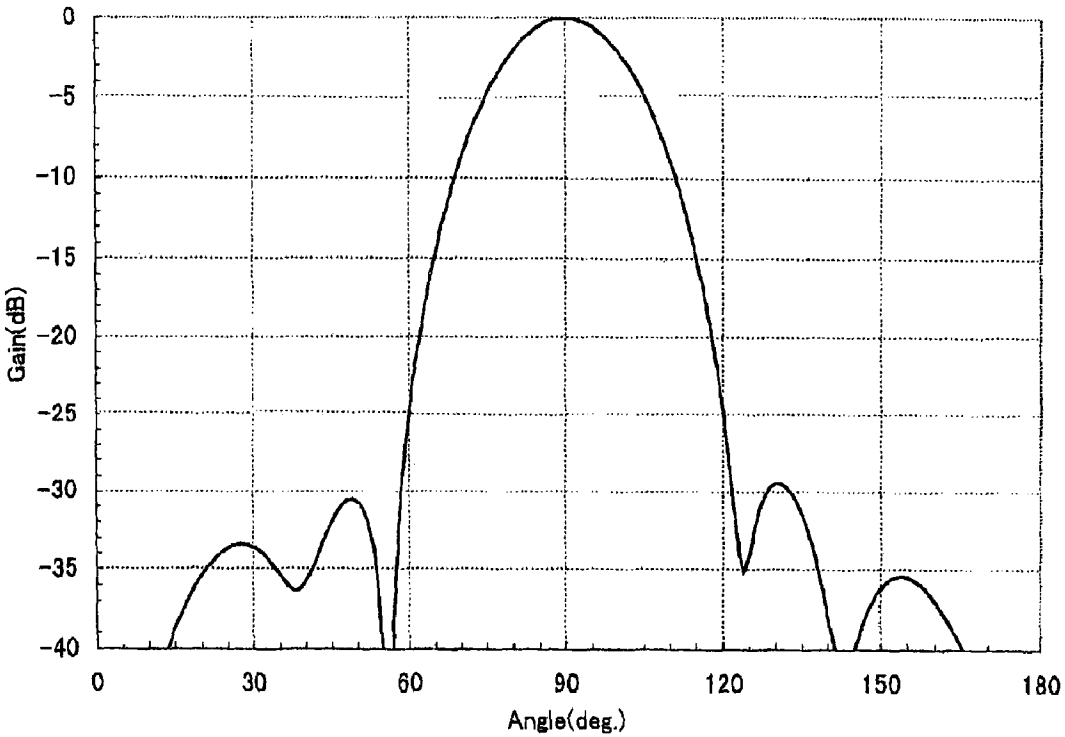
FIG. 19 shows a radiation characteristic of an array antenna when a ratio of a level of the power supplied to the radiation elements at both ends out of four radiation elements with respect to a level of the power supplied to two radiation elements in the center is set to 1:4.

An unequal three-way divider having odd-numbered output terminals more than five can be provided by combining the unequal three-way divider explained above in the first embodiment or the second embodiment with the unbalanced two-way divider set forth in Non-Patent Literature 2. FIG. 15 shows a five-way divider equipped with an unequal three-way divider and an unbalanced two-way divider according to the present invention. The five-way divider shown in FIG. 15 has a three-way divider 30, two-way dividers 31, 32, and transmission lines 33 to 36. In this five-way divider, when a power ratio of the three-way divider 30 is set to 1:1.78:1 (=9:16:9) and a power ratio of the two-way dividers 31, 32 is set to 1:8, a power ratio of the five-way divider is given by 1:8:16:8:1.

In the unequal three-way divider explained above in the first embodiment or the second embodiment, in order to cancel the offset produced by a difference in line length of the transmission line M12 and the transmission lines M13*a*, M13*b*, a difference is provided between the line length of the transmission line M16 and the line lengths of the transmission lines M17*a*, M17*b*. In this event, although such an effect of reducing the side lobe level of the array antenna is slightly sacrificed, no difference may be provided between the line length of the transmission line M16 and the line lengths of the transmission lines M17*a*, M17*b*. Also, a configuration from which the transmission lines M10, M16, M17*a*, M17*b* are removed may be employed unless the impedance matching is applied.

Also, in the unequal three-way divider explained above in the first embodiment or the second embodiment, the electrical length of the transmission line M12 among the transmission line M12 and the transmission lines M13*a*, M13*b*, which are connected in parallel with the transmission line M10, is set to ¼ wave length. But respective electrical lengths of the transmission lines M13*a*, M13*b* may be set to ¼ wave length.

The present invention is explained in detail with reference to the particular embodiments. But it is apparent to those skilled in the art that various variations and modifications can be applied without departing from a spirit and a scope of the present invention.

This application is based on Japanese Patent Application (Patent Application No. 2006-259285) filed on Sep. 25, 2006; the contents of which are incorporated herein by reference.

INDUSTRIAL APPLICABILITY

The unequal three-way divider according to the present invention is useful as the power feeding portion that divides the input signal into three in-phase signals and feeds the divided signals to the antenna elements, and the like.

The invention claimed is:

1. An unequal three-way divider for dividing an input signal into three in-phase signals whose power ratio is different between a center and both ends, the unequal three-way divider comprising:

an input terminal to which the input signal is input;

three output terminals for outputting respective one of three-divided signals; and three transmission paths provided between the input terminal and the three output terminals, and branched from the input terminal and connected to the respective three output terminals, wherein:

a transmission path connected to a center output terminal of the three output terminals, wherein the transmission path connected to the center output terminal is one of the three transmission paths, and has a first transmission line and a second transmission line which are connected in series with each other, wherein an electrical length of the second transmission line is ¼ wave length;

each of remaining two transmission paths from the three transmission paths connected to a respective one of the three output terminals other than the center output terminal at both ends out of the three transmission paths has a third transmission line and a fourth transmission line which are connected in series with each other, wherein an electrical length of the fourth transmission line is ¼ wave length;

an absorption resistor is provided between a connection point between the first transmission line and the second transmission line and a connection point between the third transmission line and the fourth transmission line; and an electrical length of the first transmission line or an electrical length of the third transmission line is ¼ wave length, wherein the transmission path connected to the center output terminal has a fifth transmission line connected in series with the second transmission line;

each of the remaining two transmission paths connected to the respective one of the three output terminals other than the center output terminal at both ends has a sixth transmission line connected in series with the fourth transmission line; and a relationship between a difference ΔL1 in electrical length between the first transmission line and the third transmission line and a difference ΔL2 in electrical length between the fifth transmission line and the sixth transmission line is set as ΔL2=−ΔL¼;

wherein characteristic impedances of the transmission lines and a resistance value of the absorption resistor are given, in order to implement the power ratio of $1:k^2:1$ (k is a real number of 1 or more), by

[Formula 1]

$$Z_{12} = \sqrt{\left(\frac{k^2+2}{k^3}\right)} \cdot Z_{10}$$

$$Z_{13} = \sqrt{k \cdot (k^2+2)} \cdot Z_{10}$$

$$Z_{14} = \frac{Z_{10}}{\sqrt{k}}$$

$$Z_{15} = \sqrt{k} \cdot Z_{10}$$

$$R_{10} = \frac{2k^2+1}{2k} \cdot Z_{10}$$

where $Z_{10}$ is a characteristic impedance of each of the fifth transmission line and the sixth transmission line, $Z_{12}$ is a characteristic impedance of the first transmission line, $Z_{14}$ is a characteristic impedance of the second transmission line, $Z_{13}$ is a characteristic impedance of the third transmission line, $Z_{15}$ is a characteristic impedance of the fourth transmission line, and $R_{10}$ is the resistance value of the absorption resistor.

2. An antenna equipment, comprising:

the unequal three-way divider as set forth in claim 1; and an array antenna having three antenna elements, each of the three antenna elements connected to respective one of the three output terminals of the unequal three-way divider.

3. An unequal three-way divider for dividing an input signal into three in-phase signals whose power ratio is different between a center and both ends, the unequal three-way divider comprising:

an input terminal to which the input signal is input;

three output terminals for outputting respective one of three-divided signals; and three transmission paths provided between the input terminal and the three output terminals, and branched from the input terminal and connected to the respective three output terminals, wherein:

a transmission path connected to a center output terminal of the three output terminals, wherein the transmission path connected to the center output terminal is one of the three transmission paths, and has a first transmission line and a second transmission line which are connected in series with each other, wherein an electrical length of the second transmission line is ¼ wave length;

each of remaining two transmission paths from the three transmission paths connected to a respective one of the three output terminals other than the center output terminal at both ends out of the three transmission paths has a third transmission line and a fourth transmission line which are connected in series with each other, wherein an electrical length of the fourth transmission line is ¼ wave length;

an absorption resistor is provided between a connection point between the first transmission line and the second transmission line and a connection point between the third transmission line and the fourth transmission line; and an electrical length of the first transmission line or an electrical length of the third transmission line is ¼ wave length, wherein the transmission path connected to the center output terminal has a fifth transmission line connected in series with the second transmission line;

each of the remaining two transmission paths connected to the respective one of the three output terminals other than the center output terminal at both ends has a sixth transmission line connected in series with the fourth transmission line; and a relationship between a difference ΔL1 in electrical length between the first transmission line and the third transmission line and a difference ΔL2 in electrical length between the fifth transmission line and the sixth transmission line is set as ΔL2=−ΔL¼;

the unequal three-way divider comprises a seventh transmission line which is provided between the input terminal and the three transmission lines and whose electrical length is ¼ wave length, wherein:

characteristic impedances of the transmission lines and a resistance value of the absorption resistor are given, in order to implement the power ratio of $1:k^2:1$ (k is a real number of 1 or more), by

[Formula 2]

$$Z_{21} = \left(\frac{k}{k^2+2}\right)^{\frac{1}{4}} \cdot Z_{10}$$

$$Z_{12} = \frac{(k^2+2)^{\frac{1}{4}}}{k^{\frac{5}{4}}} \cdot Z_{10}$$

-continued $$Z_{13} = k^{\frac{3}{4}} \cdot (k^2+2)^{\frac{1}{4}} \cdot Z_{10}$$

$$Z_{14} = \frac{Z_{10}}{\sqrt{k}}$$

$$Z_{15} = \sqrt{k} \cdot Z_{10}$$

$$R_{10} = \frac{2k^2+1}{2k} \cdot Z_{10}$$

where $Z_{10}$ is a characteristic impedance of each of the fifth transmission line and the sixth transmission line, $Z_{12}$ a characteristic impedance of the first transmission line, $Z_{14}$ is a characteristic impedance of the second transmission line, $Z_{13}$ is a characteristic impedance of the third transmission line, $Z_{15}$ is a characteristic impedance of the fourth transmission line, $Z_{21}$ is a characteristic impedance of the seventh transmission line, and $R_{10}$ is the resistance value of the absorption resistor.

4. An antenna equipment, comprising:

the unequal three-way divider as set forth in claim 3; and an array antenna having three antenna elements, each of the three antenna elements connected to respective one of the three output terminals of the unequal three-way divider.

* * * * *